US011820578B2

(12) United States Patent
Kagimoto et al.

(10) Patent No.: US 11,820,578 B2
(45) Date of Patent: Nov. 21, 2023

(54) CONSTANT TEMPERATURE CONTAINER

(71) Applicant: Panasonic Intellectual Property Management Co., Ltd., Osaka (JP)

(72) Inventors: Masahiro Kagimoto, Shiga (JP); Shinya Kojima, Kyoto (JP); Hideji Kawarazaki, Osaka (JP); Toshiaki Hirano, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 15 days.

(21) Appl. No.: 17/619,995

(22) PCT Filed: Dec. 25, 2020

(86) PCT No.: PCT/JP2020/048881
§ 371 (c)(1),
(2) Date: Dec. 16, 2021

(87) PCT Pub. No.: WO2021/132619
PCT Pub. Date: Jul. 1, 2021

(65) Prior Publication Data

US 2022/0402682 A1 Dec. 22, 2022

(30) Foreign Application Priority Data

Dec. 26, 2019 (JP) ..... 2019-237115

(51) Int. Cl.
*B65D 81/38* (2006.01)
*B65D 25/10* (2006.01)
*B65D 25/28* (2006.01)

(52) U.S. Cl.
CPC ..... *B65D 81/3823* (2013.01); *B65D 25/108* (2013.01); *B65D 25/2808* (2013.01); *B65D 81/3816* (2013.01)

(58) Field of Classification Search
CPC ..... B65D 81/3823; B65D 81/3816; B65D 81/38; B65D 25/108; B65D 25/2808
(Continued)

(56) References Cited

U.S. PATENT DOCUMENTS 907,099 A * 12/1908 Trowbridge ..... A23G 9/227 220/560.04
1,993,730 A * 3/1935 Carpenter ..... F25D 3/125 62/DIG. 13
(Continued)

FOREIGN PATENT DOCUMENTS

CN 206347259 U 7/2017
DE 212015000150 U1 2/2017
(Continued)

OTHER PUBLICATIONS

International Search Report and Written Opinion issued in corresponding International Patent Application No. PCT/JP2020/048881, dated Mar. 9, 2021, with partial English translation.
(Continued)

*Primary Examiner* — Chun Hoi Cheung
*Assistant Examiner* — Brijesh V. Patel
(74) *Attorney, Agent, or Firm* — McDermott Will & Emery LLP

(57) ABSTRACT

To improve the moldability and keeping cold performance of a vacuum heat insulating container. A constant temperature container includes a heat insulating container formed by disposing a core material between an outer cover material and an inner cover material and sealing the core material in a reduced-pressure state. The core material includes a first core material, the first core material being an organic substance made of open-cell foam, and a second core material having a lower thermal conductivity than the first core material at a vacuum degree of 100 Pa or less.

6 Claims, 4 Drawing Sheets

(58) Field of Classification Search
USPC ..... 220/592.01–592.28
See application file for complete search history.

(56) References Cited

U.S. PATENT DOCUMENTS

| | | | | | |
|---|---|---|---|---|---|
| 4,730,748 | A * | 3/1988 | Bane | B65D 81/3823 | 220/902 |
| 5,544,490 | A * | 8/1996 | Manini | B65D 81/3233 | 252/181.1 |
| 5,706,969 | A * | 1/1998 | Yamada | B65D 81/3818 | 220/592.2 |
| 9,688,454 | B2 * | 6/2017 | Ranade | B32B 27/306 | |
| 11,072,484 | B1 * | 7/2021 | Silva | B65D 43/16 | |
| 2003/0082357 | A1 * | 5/2003 | Gokay | E04B 1/803 | 428/34.1 |
| 2009/0007789 | A1 * | 1/2009 | Hirai | C22C 29/12 | 96/153 |
| 2013/0305928 | A1 * | 11/2013 | Kojima | B01D 53/0407 | 96/108 |
| 2014/0054297 | A1 * | 2/2014 | Patstone | F25D 3/08 | 220/592.01 |
| 2017/0096284 | A1 | 4/2017 | Hirano et al. | | |
| 2020/0047966 | A1 * | 2/2020 | Yamauchi | B05B 11/0038 | |

FOREIGN PATENT DOCUMENTS

| | | | |
|---|---|---|---|
| JP | 2006027625 | A * | 2/2006 |
| JP | 2006027625 | A | 2/2006 |
| JP | 2006194559 | A * | 7/2006 |
| JP | 2006194559 | A | 7/2006 |
| JP | 2008030790 | A | 2/2008 |
| JP | 2008208844 | A | 9/2008 |

OTHER PUBLICATIONS

Extended European Search Report issued in corresponding European Patent Application No. 20908035.7, dated Jun. 12, 2023.

* cited by examiner

CONSTANT TEMPERATURE CONTAINER

CROSS-REFERENCE TO RELATED APPLICATIONS

This application is the U.S. National Phase under 35 U.S.C. § 371 of International Application No. PCT/JP2020/048881, filed on Dec. 25, 2020, which claims the benefit of Japanese Application No. 2019-237115, filed on Dec. 26, 2019, the entire contents of each are hereby incorporated by reference.

TECHNICAL FIELD

The present invention relates to a constant temperature container.

BACKGROUND ART

A constant temperature container has been conventionally used as a container for maintaining a stored item such as pharmaceuticals within a certain temperature range for a certain time. A vacuum heat insulating container is used as the constant temperature container to improve a heat insulating property. This type of vacuum heat insulating container is manufactured by sealing, under reduced pressure, a core material with a cover material including an aluminum layer formed by vapor deposition or lamination (e.g., refer to Patent Literature 1).

CITATION LIST

Patent Literature

[Patent Literature 1]
Japanese Patent Laid-Open No. 2008-030790

SUMMARY OF INVENTION

Technical Problem

However, the vacuum heat insulating container described in Patent Literature 1 is difficult to mold and has room for improvement in keeping cold performance.

An object of the present invention, which has been made in view of the above circumstances, is to improve the moldability and keeping cold performance of a heat insulating container.

Solution to Problem

The entire contents of Japanese Patent Application No. 2019-237115 filed on Dec. 26, 2019 are incorporated in this specification.

In order to achieve the above object, a constant temperature container according to an aspect of the present invention includes a heat insulating container formed by disposing a core material between an outer cover material and an inner cover material and sealing the core material in a reduced-pressure state. The core material includes a first core material, the first core material being an organic substance made of open-cell foam, and a second core material having a lower thermal conductivity than the first core material at a vacuum degree of 100 Pa or less.

Accordingly, it is possible to improve the keeping cold performance of the constant temperature container and maintain the robustness thereof without loss of moldability which is a characteristic of the first core material by employing the second core material having a lower thermal conductivity than the first core material at a vacuum degree of 100 Pa or less in the core material.

Advantageous Effects of Invention

According to the aspect of the present invention, it is possible to improve the moldability of the heat insulating container and improve the keeping cold performance of the constant temperature container.

DESCRIPTION OF EMBODIMENTS

Figure 1:
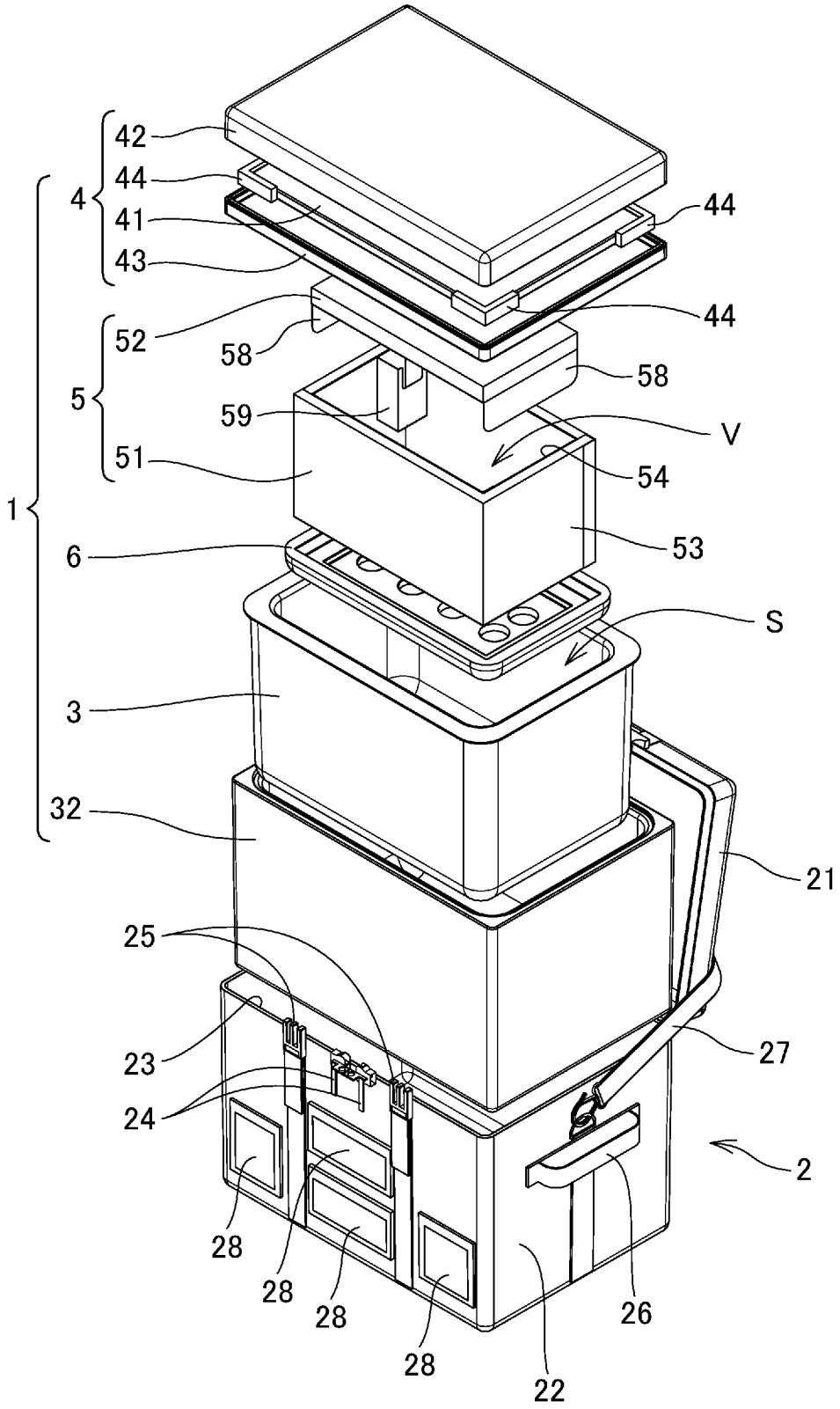
FIG. 1 is an exploded perspective view of a constant temperature container according to an embodiment of the present invention.

According to a first aspect of the invention, a constant temperature container includes a heat insulating container formed by disposing a core material between an outer cover material and an inner cover material and sealing the core material in a reduced-pressure state. The core material includes a first core material, the first core material being an organic substance made of open-cell foam, and a second core material having a lower thermal conductivity than the first core material at a vacuum degree of 100 Pa or less.

Accordingly, it is possible to improve the keeping cold performance of the constant temperature container and maintain the robustness thereof without loss of moldability which is a characteristic of the first core material by employing the second core material having a lower thermal conductivity than the first core material at a vacuum degree of 100 Pa or less in the core material.

According to a second aspect of the invention, the second core material is an inorganic substance.

There is an inorganic substance exhibiting a higher thermal conductivity than the first core material, which is the organic substance, within a practical vacuum degree range of 100 Pa or less. However, in the second aspect of the invention, since the inorganic substance having a lower thermal conductivity than the first core material, which is the organic substance, at a vacuum degree of 100 Pa or less is employed as the second core material, it is possible to improve the keeping cold performance of the constant temperature container and maintain the robustness thereof without loss of moldability which is a characteristic of the first core material.

According to a third aspect of the invention, the second core material includes an inorganic fiber, and the inorganic fiber is disposed perpendicular to a thickness direction of a wall portion of the heat insulating container.

Accordingly, when heat is transmitted through the core material in the thickness direction of the heat insulating container, a heat transmission path becomes longer than the thickness, and heat transmission is suppressed. Thus, the keeping warm performance of the constant temperature container is improved.

According to a fourth aspect of the invention, a peripheral edge of the second core material is impregnated with the organic substance made of the open-cell foam.

Accordingly, a gap is less likely to be produced at a boundary between the core material made of the inorganic substance and the core material made of the organic substance. This reduces the possibility of a part of the core material becoming thin and improves the keeping warm performance of the constant temperature container.

According to a fifth aspect of the invention, the second core material is located on an upper side of a wall portion of the heat insulating container.

Thus, the rigidity of the opening side of the core material is improved by the core material made of the inorganic substance, which improves the molding accuracy of an opening of the heat insulating container. A gap is less likely to be produced between the opening and a lid which closes the opening, and the keeping warm performance of the heat insulating container is thus improved.

According to a sixth aspect of the invention, the second core material is located on an inner side of a wall portion of the heat insulating container.

When, for example, open-cell urethane is employed as the first core material, the thermal conductivity of open-cell urethane tends to decrease at temperatures lower than room temperature. Accordingly, in the heat insulating container transported at a temperature around room temperature or higher than room temperature, the keeping warm performance can be improved by disposing the core material made of the inorganic substance having small temperature dependence of thermal conductivity on the inner side of the wall portion.

According to a seventh aspect of the invention, the second core material is located on an outer side of a wall portion of the heat insulating container.

When, for example, open-cell urethane is employed as the first core material, the thermal conductivity of open-cell urethane tends to decrease at temperatures lower than room temperature. Accordingly, in the heat insulating container transported within a temperature range of 2° C. to 8° C. or at a temperature lower than room temperature, the keeping warm performance can be improved by disposing the core material made of the inorganic substance on the outer side of the wall portion.

Hereinbelow, an embodiment of the present invention will be described with reference to the drawings.

Figure 2:
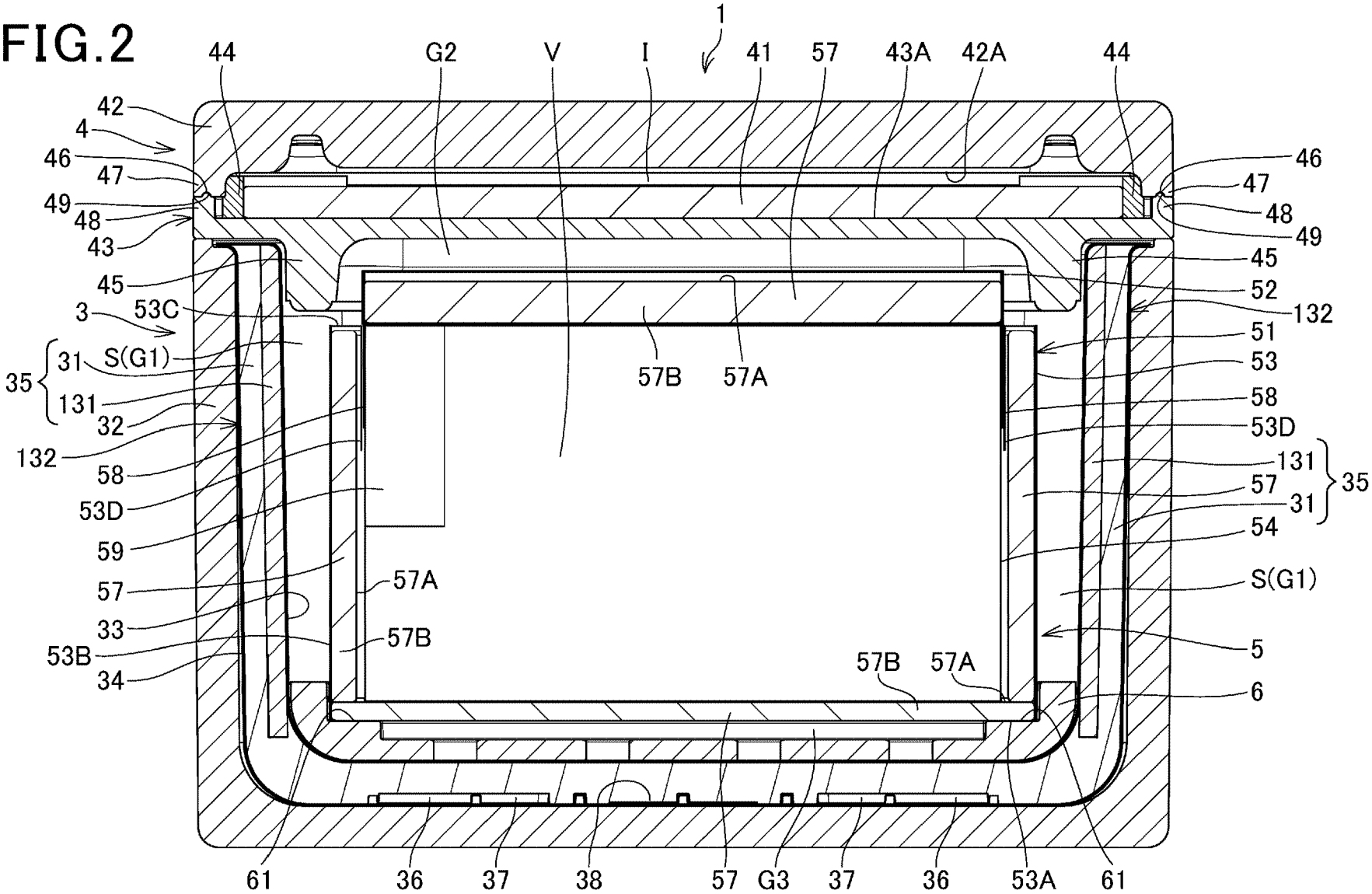
FIG. 2 is a vertical sectional view in a longitudinal direction of the constant temperature container.

FIG. 1 is an exploded perspective view of a constant temperature container 1 and a container case 2 according to the embodiment of the present invention. FIG. 2 is a vertical sectional view in a longitudinal direction of the constant temperature container 1.

As shown in FIG. 1, the constant temperature container 1 is housed in the container case 2 when used.

As shown in FIGS. 1 and 2, the constant temperature container 1 includes a vacuum heat insulating container (heat insulating container) 3 as a body container, a vacuum heat insulating lid 4 as a body lid, and a storage box 5 which is housed in the vacuum heat insulating container 3.

Figure 3:
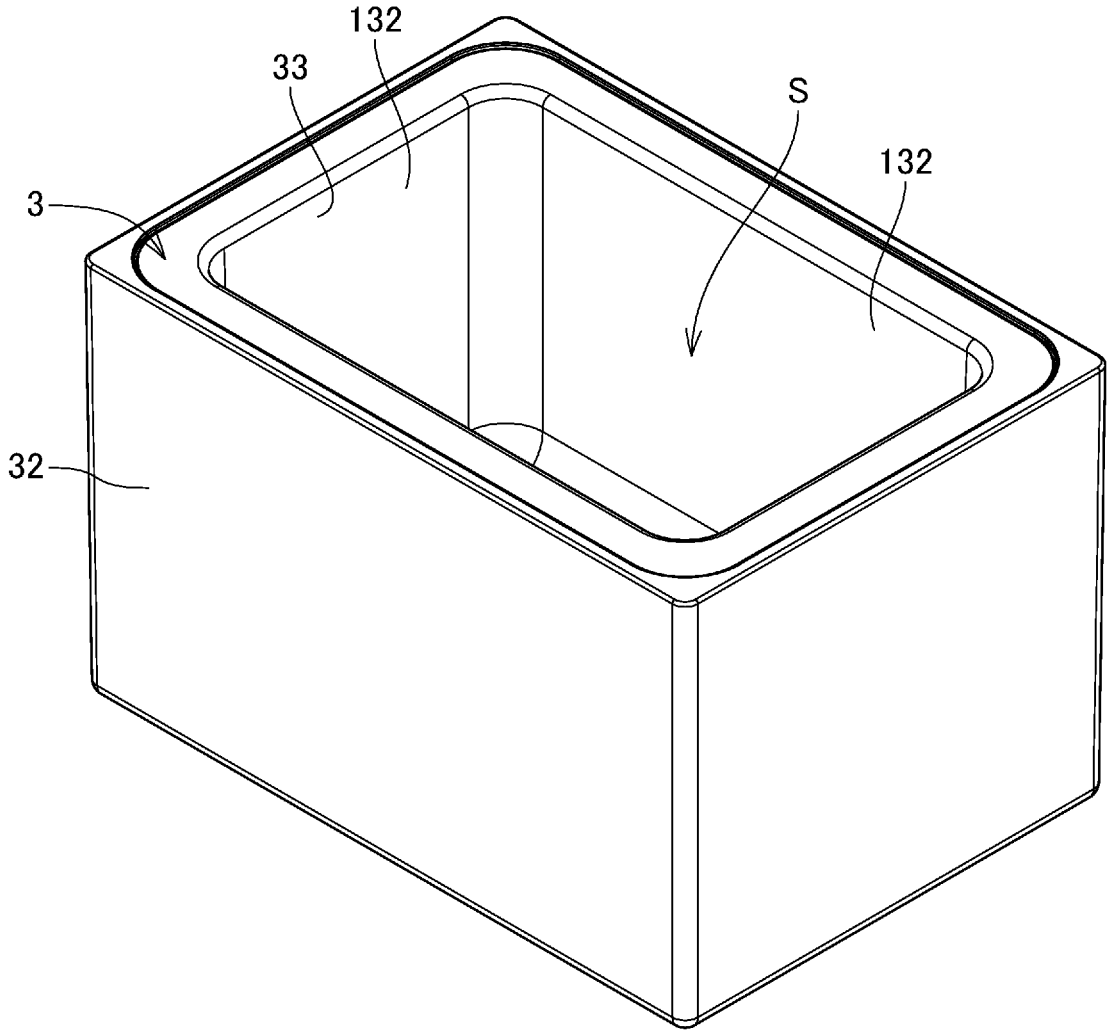
FIG. 3 is a perspective view of a body container.

As shown in FIG. 3, an outer surface of the vacuum heat insulating container 3 is covered by a body protection case 32 as a housing. The body protection case 32 may be formed of a resin having a heat insulating property, such as styrene foam. Further, when the body protection case 32 is formed of a resin having shock absorbency, shock to the vacuum heat insulating container 3 is reduced.

As shown in FIG. 2, the vacuum heat insulating container 3 includes an outer cover material 34 indicated by a thick line in the drawing. The outer cover material 34 is formed in a box shape with an open upper face, and an inner cover material 33 indicated by a thick line in the drawing is disposed inside the outer cover material 34. The inner cover material 33 has a dimension that allows a predetermined clearance to be left from each side face and a bottom face of the outer cover material 34.

A core material 35 indicated by hatched lines is housed between the outer cover material 34 and the inner cover material 33. An outer peripheral edge between the outer cover material 34 and the inner cover material 33 is sealed with the core material 35 housed. Air between the outer cover material 34 and the inner cover material 33 is discharged to seal the core material 35 under reduced pressure. Accordingly, the vacuum heat insulating container 3 having a vacuum heat insulating function is formed. A storage space S is provided inside the vacuum heat insulating container 3.

Although the outer cover material 34 and the inner cover material 33 are not limited to any particular material, the outer cover material 34 and the inner cover material 33 are molded of a resin material having an excellent gas barrier property. For example, a resin that releases a small amount of gas in a vacuum, such as polypropylene or an ethylene-vinyl alcohol copolymer, is used.

A gas adsorbent 36, a water adsorbent 37, and a reinforcing plate 38 having a hole on its center are disposed between a bottom portion of the outer cover material 34 and the core material 35. The vacuum heat insulating container 3 releases less heat from a bottom face than from each side face. Thus, disposing the gas adsorbent 36, the water adsorbent 37, and the reinforcing plate 38 on the bottom face of the vacuum heat insulating container 3 does not interfere with a heat insulating effect.

An exhaust hole for evacuating the vacuum heat insulating container 3 is provided at a position corresponding to the hole of the reinforcing plate 38 of the outer cover material 34, and the exhaust hole is closed with a sealing material (not illustrated) after the evacuation of the vacuum heat insulating container 3. The reinforcing plate 38 can reduce deformation around the exhaust hole and support the sealing material in evacuation or closing the exhaust hole with the sealing material.

The vacuum heat insulating lid 4 is a member that closes an opening of the vacuum heat insulating container 3, and includes a lid outer protection case 42 having an outer shape similar to the outer shape of the body protection case 32. An upper joint portion 47 extending downward is formed on a peripheral edge of a lower face of the lid outer protection case 42 over the entire circumference of the lid outer protection case 42. A joint recess 46 is formed on a lower face of the upper joint portion 47.

An outer housing portion 42A which is surrounded by the upper joint portion 47 and has a recessed shape is formed on the lower face of the lid outer protection case 42.

A lid inner protection case 43 is disposed under the lid outer protection case 42. A lower joint portion 48 extending upward is formed on a peripheral edge of an upper face of the lid inner protection case 43 over the entire circumference of the lid inner protection case 43. A joint projection 49 is formed on an upper face of the lower joint portion 48.

An inner housing portion 43A which is surrounded by the lower joint portion 48 and has a recessed shape is formed on the upper face of the lid inner protection case 43.

The lid outer protection case 42 and the lid inner protection case 43 are integrally formed by joining the joint recess 46 of the upper joint portion 47 and the joint projection 49 of the lower joint portion 48 to each other. In this state, a predetermined internal space I is defined by the outer housing portion 42A of the lid outer protection case 42 and the inner housing portion 43A of the lid inner protection case 43.

A vacuum heat insulating plate 41 is housed in the internal space I. Fixing members 44 each having a substantially L shape are attached to four corners of the vacuum heat insulating plate 41. The vacuum heat insulating plate 41 can be fixed so as not to move inside the internal space I by the fixing members 44 abutting against the four corners of the internal space I in a state where the vacuum heat insulating plate 41 is housed in the internal space I.

The vacuum heat insulating plate 41 may be fixed to the lid outer protection case 42 and the lid inner protection case 43 by using not the fixing members 44 each having a substantially L shape, but, for example, a linear fixing member provided along each side of the vacuum heat insulating plate 41 or an adhesive.

Although the vacuum heat insulating plate 41 is formed of the same material as the vacuum heat insulating container 3, for example, a vacuum heat insulating material including a core material sealed-in with a resin film having a gas barrier property may be used as the vacuum heat insulating plate 41.

The lid outer protection case 42 and the lid inner protection case 43 are formed of the same material as the body protection case 32.

A projecting portion 45 projecting downward is formed near an outer periphery of a lower face of the lid inner protection case 43. An outer side face of the projecting portion 45 abuts against an inner side face of the vacuum heat insulating container 3 in a state where the vacuum heat insulating lid 4 is attached to the vacuum heat insulating container 3 to close the upper face of the vacuum heat insulating container 3. Providing the projecting portion 45 makes it possible to set a long heat entry path between the vacuum heat insulating container 3 and the vacuum heat insulating lid 4, thereby improving the heat insulating performance of the constant temperature container 1.

Figure 4:
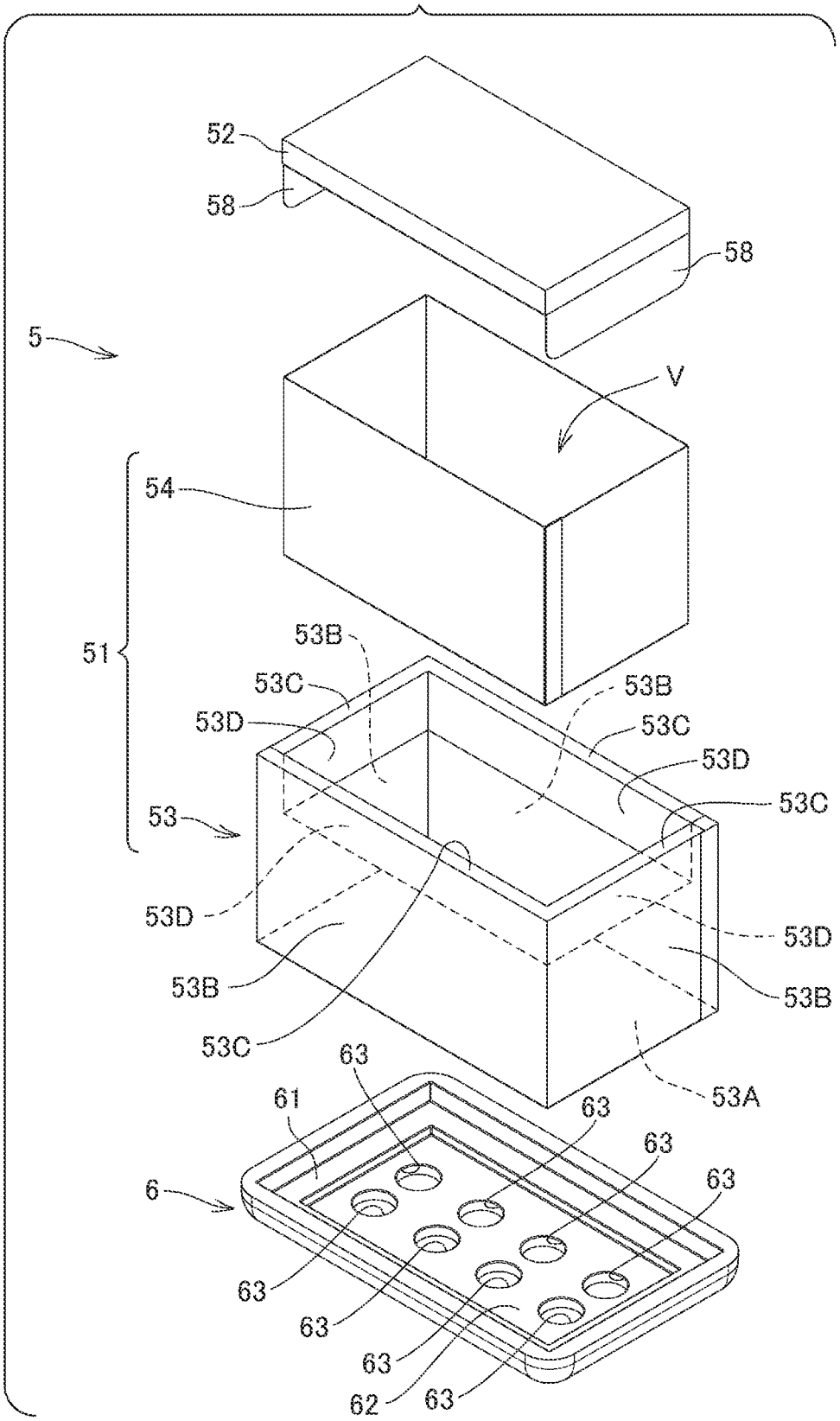
FIG. 4 is an exploded perspective view of a storage box and a fixing body.

FIG. 4 is an exploded perspective view of the storage box 5 and a support member 6. In FIG. 4, a logger case 59 is omitted.

As shown in FIG. 1, the storage box 5 is removably housed in the storage space S of the vacuum heat insulating container 3. As shown in FIG. 4, the storage box 5 includes a box body 51 and a box lid 52. The box body 51 includes an outer box 53 having a box shape with an open upper face. The outer box 53 includes a bottom plate 53A having a rectangular shape and four side plates 53B which are provided in a standing manner on four sides of the bottom plate 53A. An upper plate 53C is formed on an upper end edge of each of the side plates 53B, the upper plate 53C extending inward of the outer box 53 with a predetermined width dimension. A folded-back plate 53D extending downward is integrally formed with an inner edge of each of the upper plates 53C. The folded-back plate 53D extends up to a position corresponding to a midway part of each side plate 53B.

An inner box 54 having a box shape with an open upper face is housed inside the outer box 53. The inner box 54 is formed in such a manner as to abut against an inner face of the folded-back plate 53D.

The outer box 53 and the inner box 54 are both molded into a box shape by bending a sheet-like resin material having plasticity. Examples of the resin material include transparent polypropylene and ABS resin.

Cold storage agents 57 each having a flat-plate shape are stored between each side plate 53B and the corresponding folded-back plate 53D and on an upper face of the bottom plate 53A of the outer box 53. The cold storage agent 57 disposed on the bottom plate 53A is disposed over substantially the entire face of the bottom plate 53A, and a lower end of the cold storage agent 57 disposed on each side plate 53B is in contact with the cold storage agent 57 disposed on the bottom plate 53A.

The cold storage agents 57 are stored in the box body 51 and the box lid 52 with peripheral edges of covers 57A bent. The covers 57A are bent in such a manner as not to be located between the adjacent cold storage agents 57. This enables the cold storage agents 57 to be closely disposed.

That is, the cold storage agents 57 are disposed on the bottom portion and the wall portion of the box body 51 with no thermal gap therebetween. This makes it possible to reduce heat transfer from the outside of the storage box 5, thereby maintaining the inside of the storage box 5 within a predetermined temperature range. Since each folded-back plate 53D is formed up to the position corresponding to the midway part of the corresponding side plate 53B, it is easy to store the cold storage agent 57 between each side plate 53B and the corresponding folded-back plate 53D.

Each cold storage agent 57 is held between the outer box 53 and the inner box 54 by storing the inner box 54 inside the outer box 53 after storing the cold storage agent 57. This makes it possible to reliably support and fix each cold storage agent 57 having a plate shape and prevent the cold storage agents 57 from separating from each other during conveyance of the constant temperature container 1. A storage space V for storing a stored item such as pharmaceuticals is provided inside the box body 51, that is, inside the inner box 54.

The box lid 52 is a member that closes an opening of the box body 51 to constitute a top face of the storage box 5. The box lid 52 is formed in a thin box shape by bending the same resin material as the box body 51, and the outer shape of the box lid 52 is substantially the same as the shape of the upper opening of the box body 51.

Insertion portions 58 each of which extends downward and has a plate shape (flap shape) are formed on respective lower edges of the box lid 52, the lower edges being located on the opposite sides in the longitudinal direction. Each of the insertion portions 58 has the same width dimension as the box lid 52.

In closing the upper opening of the box body 51 with the box lid 52, each insertion portion 58 is inserted between the corresponding folded-back plate 53D and the inner box 54 to fix the box lid 52.

The box lid 52 has substantially the same shape as the upper opening of the box body 51 and the width dimension of the insertion portions 58 is the same as the width dimension of the box lid 52. Thus, each of the insertion portions 58 inserted between the folded-back plate 53D and the inner box 54 is located on the width of the upper opening of the box body 51, which enables appropriate positioning of the box lid 52 on the box body 51. The cold storage agent 57 is stored inside the box lid 52.

The cold storage agents 57 maintain the inside of the storage box 5 at a temperature lower than ambient temperature, for example, at approximately 2 to 8° C. Each of the cold storage agents 57 of the present embodiment includes a phase change material 57B capable of using transition heat caused by phase change or phase transition of a substance, and stores such transition heat as heat energy and is used as a latent heat storage material. The cold storage agent 57 is formed by covering the phase change material 57B with the cover 57A made of resin.

When the cold storage agent 57 is cooled, the phase change material 57B undergoes a phase change from liquid or gel to solid. On the other hand, when the cold storage agent 57 absorbs heat to increase its temperature, the phase change material 57B undergoes a phase change from solid to liquid or gel.

That is, the cold storage agent 57 is brought into a state where cold heat is stored through the phase change of the phase change material 57B to solid, which enables the cold storage agent 57 to absorb heat.

The logger case 59 (refer to FIG. 1) in which a data logger including various sensors is housed is provided on a corner inside the storage box 5. For example, as the data logger, a data logger capable of measuring temperature can be used. Further, a data logger capable of measuring position and acceleration and transmitting information of the measured position and acceleration can be used.

A phase change material obtained by appropriately mixing an additive to various paraffins to adjust a freezing point or a melting point where a phase change occurs to a predetermined temperature is used as the phase change material 57B of the cold storage agent 57. By using such a phase change material 57B, attenuation of radio waves in the UHF and SHF bands can be made extremely smaller than that in the case of water.

Thus, information can be efficiently transmitted from the inside of the storage box 5 to the outside of the constant temperature container 1 using a communication line for cellular phones or RFID.

The support member 6 is housed in a bottom portion of the storage space S of the vacuum heat insulating container 3. The support member 6 is formed in a substantially flat-plate shape, and a support recess 61 having substantially the same shape as the outer shape of the storage box 5 is formed on an upper face of the support member 6. The support member 6 is formed of, for example, a heat insulating material such as styrene foam.

The storage box 5 is housed, and supported and fixed inside the vacuum heat insulating container 3 by being placed on the support recess 61 of the support member 6. In this state, an outer side face of the storage box 5 is disposed with a predetermined clearance G1 left from the inner side face of the vacuum heat insulating container 3. Similarly, the box lid 52 is disposed with a predetermined clearance G2 left from the lower face of the vacuum heat insulating lid 4 and the projecting portion 45. Further, the clearance recess 62 includes a plurality of through holes 63.

The constant temperature container 1 is housed in the container case 2 so that the constant temperature container 1 is easily carried in conveying a stored item. The container case 2 includes a case body 22 having a box shape with an open upper face and a case lid 21 which is coupled to one side edge of an upper portion of the case body 22.

The case lid 21 and the case body 22 can be closed with a case fastener 23. A handle 24 is attached to the case fastener 23 to open and close the case fastener 23.

A plurality of case lid fixtures 25 are provided on a front face of the case body 22. A plurality of fixing belts provided on a top face of the case lid 21 are coupled to the case lid fixtures 25 so that the container case 2 and the constant temperature container 1 can be more reliably maintained in a closed state.

Handles 26 are provided on respective side faces of the container case 2, and a conveyance belt 27 is coupled to the side faces. The handles 26 and the conveyance belt 27 enable easy conveyance of the container case 2 and the constant temperature container 1. A plurality of document storage portions 28 are provided on the front face of the container case 2.

According to the present embodiment, the core material 35 described above is housed between the outer cover material 34 and the inner cover material 33, and the core material 35 includes a first core material 31 which is an organic substance and a second core material 131 which is an inorganic substance in combination.

The second core material 131, which is the inorganic substance, is annularly disposed on the inner peripheral side of the first core material 31, which is the organic substance, when the vacuum heat insulating container 3 is viewed from above.

The first core material 31, which is the organic substance, is not limited to any particular material. The first core material 31 is made of, for example, polyol or isocyanate, and an open-cell urethane material, such as urethane foam having an open-cell structure, can be used.

As the second core material 131, which is the inorganic substance, an inorganic substance having a lower thermal conductivity than the first core material 31, which is the organic substance, at a vacuum degree of 100 Pa or less is employed. For example, an inorganic material used as a core material of a vacuum heat insulating material, such as a molded article made of glass fiber or a molded article made of fumed silica, can be used. There is an inorganic substance exhibiting a higher thermal conductivity than the first core material 31, which is the organic substance, within a practical vacuum degree range of 100 Pa or less. However, according to the present embodiment, since the inorganic substance having a lower thermal conductivity than the first core material 31, which is the organic substance, at a vacuum degree of 100 Pa or less is employed as the second core material 131, it is possible to improve the keeping cold performance of the constant temperature container 1 and maintain the robustness thereof without loss of moldability which is a characteristic of the first core material 31, which is the organic substance.

Since the first core material 31 which is the organic substance of open-cell foam and the second core material 131 which is the inorganic substance having a higher specific heat than an organic substance are used in combination in the core material 35, the heat capacity of the vacuum heat insulating container 3 increases and the keeping warm performance of the constant temperature container 1 can thus be improved as compared to a case where the core material 35 is made of only the organic substance of open-cell foam.

According to the present embodiment, a vacuum pump (not illustrated) is connected to the exhaust hole (not illustrated) provided on the reinforcing plate 38 (refer to FIG. 2) of the outer cover material 34.

The outer peripheral edge between the outer cover material 34 and the inner cover material 33 is sealed with the core material 35 housed, and air between the outer cover material 34 and the inner cover material 33 is sucked through the vacuum pump (not illustrated) at a vacuum degree within a practical range of 100 Pa or less, for example, a vacuum degree of 10 Pa to seal the core material 35 under reduced pressure.

Since the core material 35 includes the second core material 131 which is the inorganic substant having a low thermal conductivity, the heat insulating performance is improved, and the keeping warm performance of the constant temperature container 1 can thus be improved.

According to the present embodiment, the second core material 131 includes an inorganic fiber (not illustrated).

The inorganic fiber (not illustrated) is disposed perpendicular to a thickness direction of a wall portion 132 (refer to FIG. 3) of the vacuum heat insulating container 3 (disposed in the vertical direction in FIG. 2).

Accordingly, when heat is transmitted through the core material 35 in the thickness direction of the vacuum heat insulating container 3, the heat passes through the inorganic fiber, which makes a heat transmission path longer than the thickness and suppresses heat transmission. Thus, the keeping warm performance of the constant temperature container 1 can be improved.

According to the present embodiment, a peripheral edge portion of the second core material 131 is impregnated with the organic substance made of the open-cell foam. Thus, a gap is less likely to be produced at a boundary between the second core material 131 made of the inorganic substance and the first core material 31 made of the organic substance. This reduces the possibility of a part of the core material 35 becoming excessively thin, and the keeping warm performance of the constant temperature container 1 can be improved.

According to the present embodiment, the second core material 131 is located at least on the upper side of the wall portion 132 of the vacuum heat insulating container 3, that is, located close to an opening of the wall portion 132. Thus, the rigidity of the core material 35 at the position close to the opening is improved by the second core material 131 made of the inorganic substance, which makes it possible to improve the molding accuracy of the opening of the vacuum heat insulating container 3. Accordingly, a gap is less likely to be produced between the opening and the vacuum heat insulating lid 4 which closes the opening, and the keeping warm performance of the vacuum heat insulating container 3 can thus be improved.

According to the present embodiment, the second core material 131 is located close to the inner side of the wall portion 132 of the vacuum heat insulating container 3. When, for example, open-cell urethane is employed as the first core material 31, the thermal conductivity of open-cell urethane decreases at temperatures lower than room temperature. In the vacuum heat insulating container 3 transported at a temperature around room temperature or higher than room temperature, the keeping warm performance can be improved by disposing the second core material 131 close to the inner side of the wall portion 132, the second core material 131 being made of the inorganic substance having small temperature dependence of thermal conductivity.

On the other hand, in the vacuum heat insulating container 3 transported within a temperature range of 2° C. to 8° C. or at a temperature lower than room temperature, the second core material 131 made of the inorganic substance may be disposed close to the outer side of the wall portion 132.

Accordingly, the keeping warm performance can be improved.

According to the present embodiment, the density of the second core material 131, which is the inorganic substance, is, for example, equal to or higher than 150 kg/m$^3$ at atmospheric pressure. Accordingly, dimensional changes of the core material 35 are reduced when the pressure inside the vacuum heat insulating container 3 is reduced. Thus, it is possible to reduce, for example, the possibility of a part of the core material 35 becoming excessively thin and improve the keeping warm performance of the vacuum heat insulating container 3.

According to the present embodiment, the outer cover material 34 and the inner cover material 33 are made of resin. Since the cover materials are made of resin, the amount of heat coming in and out through the cover materials is reduced as compared to a case where a metal layer is included. Thus, the keeping warm performance of the vacuum heat insulating container 3 can be improved.

INDUSTRIAL APPLICABILITY

The constant temperature container according to the present invention can be suitably used as a constant temperature container for storing an item that is kept cold or warm within a certain temperature range and requires quality control during transport.

REFERENCE SIGNS LIST

1 constant temperature container
3 vacuum heat insulating container (heat insulating container)
31 first core material
33 inner cover material
34 outer cover material
35 core material
131 second core material
132 wall portion

The invention claimed is:

1. A constant temperature container comprising:

a heat insulating container formed by disposing a core material between an outer cover material and an inner cover material and sealing the core material in a reduced-pressure state, wherein the outer cover material of the heat insulating container is formed in a box shape, the inner cover material of the heat insulating container is disposed with a predetermined clearance with respect to each side surfaces and a bottom surface of the outer cover material, one surface of the heat insulating container that is box-shaped is an open face, and an opening of the heat insulating container is formed by each side surfaces of the inner cover material, a first core material being an organic substance made of open-cell foam is disposed in the predetermined clearance at the bottom surface side of the heat insulating container as the core material, the first core material and a second core material being an inorganic substance are disposed in combination in the predetermined clearance at each side surfaces side of the heat insulating container as the core material, the second core material is formed in an annular shape facing each side surfaces of the outer cover material and in contact with the inner cover material, and the second core material is disposed closer to an opening side of the heat insulating container.

2. The constant temperature container according to claim 1, wherein the second core material has a lower thermal conductivity than the first core material at a vacuum degree of 100 Pa or less.

3. The constant temperature container according to claim 1, wherein the second core material includes an inorganic fiber, and the inorganic fiber is disposed perpendicular to a thickness direction of a wall portion of the heat insulating container.

4. The constant temperature container according to claim 1, wherein a peripheral edge of the second core material is impregnated with the organic substance made of the open-cell foam.

5. The constant temperature container according to claim 1, wherein a reinforcing plate having an exhaust hole for evacuating inside of the predetermined clearance is disposed on the bottom surface of the outer cover material.

6. The constant temperature container according to claim 1, wherein a gas adsorbent or a water adsorbent are disposed on the bottom surface of the outer cover material.

* * * * *